US007290625B2

(12) United States Patent
Amaudric Du Chaffaut et al.

(10) Patent No.: US 7,290,625 B2
(45) Date of Patent: Nov. 6, 2007

(54) REVERSE-CIRCULATION DRILLING METHOD AND SYSTEM

(75) Inventors: Benoit Amaudric Du Chaffaut, Voisin le Bretonneux (FR); Christian Wittrisch, Rueil Malmaison (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 36 days.

(21) Appl. No.: 11/221,805

(22) Filed: Sep. 9, 2005

(65) Prior Publication Data

US 2006/0060385 A1 Mar. 23, 2006

(30) Foreign Application Priority Data

Sep. 17, 2004 (FR) ..... 04 09901

(51) Int. Cl.
*E21B 4/00* (2006.01)

(52) U.S. Cl. ..... 175/107; 175/103; 175/217

(58) Field of Classification Search ..... 175/107, 175/213, 217, 103, 162, 202, 203, 220
See application file for complete search history.

(56) References Cited

U.S. PATENT DOCUMENTS

| | | | | |
|---|---|---|---|---|
| 4,137,975 | A | 2/1979 | Pennock | |
| 4,223,747 | A | 9/1980 | Marais | |
| 4,669,555 | A * | 6/1987 | Petree | 175/97 |
| 5,230,388 | A | 7/1993 | Cherrington | |
| 6,305,469 | B1 | 10/2001 | Coenen | |

FOREIGN PATENT DOCUMENTS

EP 0244076 A2 11/1987

* cited by examiner

*Primary Examiner*—David Bagnell
*Assistant Examiner*—Giovanna M Collins
(74) *Attorney, Agent, or Firm*—Antonelli, Terry, Stout & Kraus, LLP.

(57) ABSTRACT

A reverse-circulation drilling method and system includes a drill bit, a drill string having drill rods, and a rotary table or power swivel for bringing the drill bit into rotation by means of the rods. The system includes a positive-displacement pump made up of a stator and of a rotor, the stator being inserted in the drill rods, and the rotor being assembled to operating rods arranged within the drill rods.

9 Claims, 2 Drawing Sheets

REVERSE-CIRCULATION DRILLING METHOD AND SYSTEM

FIELD OF THE INVENTION

The present invention relates to the sphere of drilling, in particular rotary drilling, i.e. by rotating a drill string connected to a rock destruction bit. More precisely, the present invention is applied within the scope of the reverse-circulation drilling technique.

BACKGROUND OF THE INVENTION

This reverse-circulation drilling technique can be considered as non-conventional in relation to standard drilling with direct circulation through the inside of the rods wherein the surface injection pressure often ranges between 100 and 300 bars, considering mainly the pressure drops in the string, and the pressure dissipated by the nozzles of the bit for cleaning and cooling it, and for eroding the formation. The cuttings-laden mud flows back up through the annular space between the borehole and the drill string.

Reverse-circulation drilling consists in injecting the drilling fluid at the surface through the annular space and to circulate the cuttings-laden fluid back up through the inside of the drill string.

SUMMARY OF THE INVENTION

The present invention thus relates to a reverse-circulation drilling system comprising:

a drill bit, a drill string comprising drill rods, means for bringing said bit into rotation by means of said rods. The system comprises a positive-displacement pump consisting of a stator and of a rotor, said stator being inserted in said drill rods, and the rotor is assembled to operating rods arranged within the drill rods.

The rotor can be driven into rotation in relation to said stator by at least one of the following actions: rotation of the drill rods, rotation of the operating rods connected to the rotor.

The rotor of the pump can be disengaged from the stator by dismounting the operating rods.

The invention also relates to a reverse-circulation drilling method comprising:

rotating a drill bit by means of a drill string, circulating a drilling fluid in the borehole. According to the method, pumping means are arranged in said string so as to draw the drilling fluid coming from the well bottom through the inner space of the drill rods and to discharge said fluid to the surface through the inner space of the rods, so as to provide a reverse circulation.

The pumping means can comprise a stator screwed between drill rods and a rotor assembled to operating rods arranged within the drill rods, said stator being driven into rotation with the drill rods.

The rotor can be driven into rotation by the operating rods.

The fluid level in the well can be controlled by the flow rate of said pump and the filling rate of the well.

The rotor can be removed by dismounting the operating rods so as to leave the inner space of the string free.

Direct circulation can be restored by injecting the drilling fluid by means of surface pumps through the inner space of the drill string.

BRIEF DESCRIPTION OF THE FIGURES

Other features and advantages of the invention will be clear from reading the description hereafter of an embodiment given by way of non limitative example, with reference to the accompanying figures wherein.

DETAILED DESCRIPTION

Figure 1:
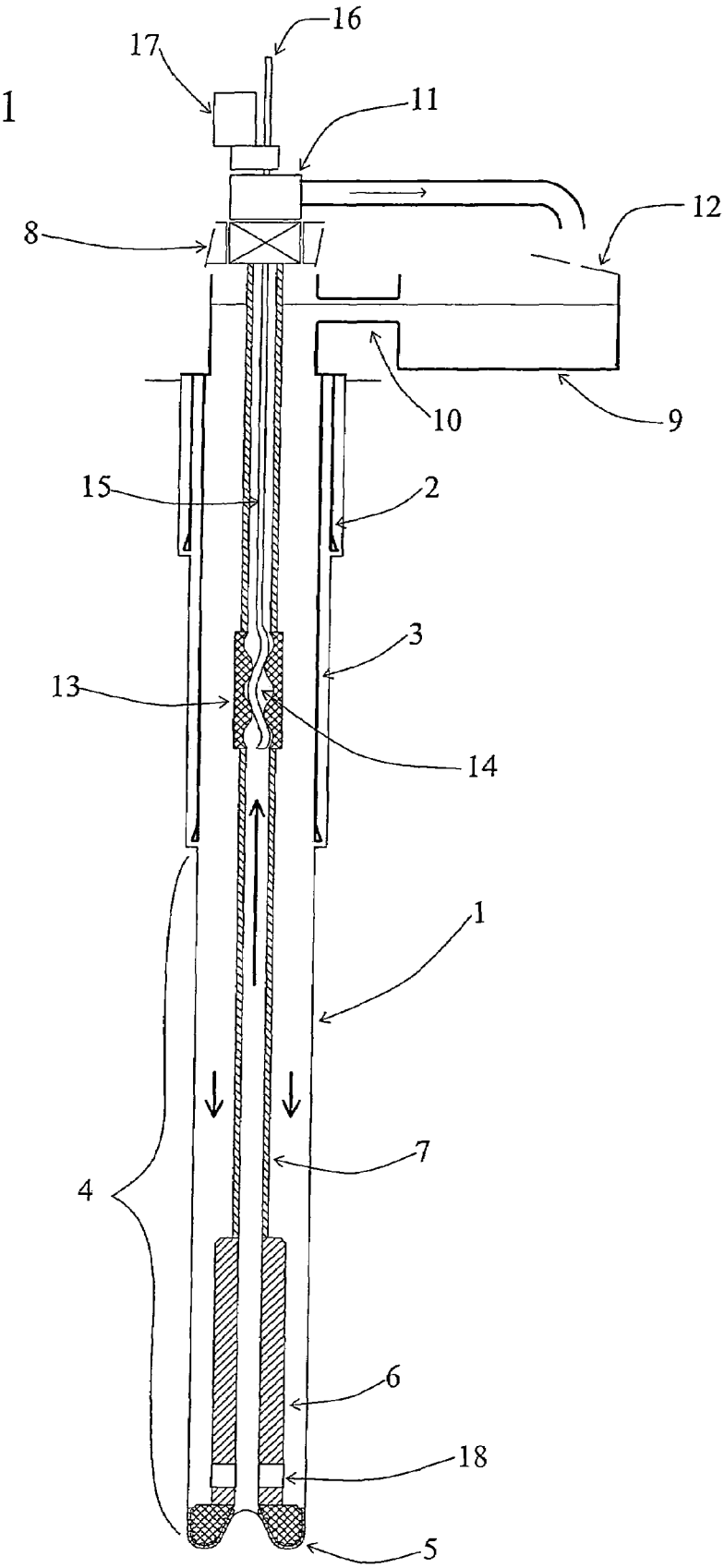
FIG. 1 diagrammatically shows the principle of the invention.

FIG. 1 diagrammatically shows a well 1 drilled, or under drilling, in the ground. In this figure, the well is partly cased by a surface casing 2 and an intermediate casing 3. The part of the well bearing reference number 4 is an open-hole section.

A drill string is arranged in the well. This string consists of a drill bit 5, of drill collars 6 and of drill rods 7 whose assemblies run up to the ground surface. Means for rotating the whole of the string bear reference number 8. These rotation means can consist of a rotary table or of a power swivel.

The drilling fluid circulation system comprises surface tanks 9 connected to the wellhead by a pipe 10 so as to fill the well by overflow. The head in the annulus of well 1 is provided by the fluid level in the tanks. A circulating head 11 provided with a rotating connection collects the drilling fluid returning to the mud tanks by passing on separation means 12.

According to the invention, stator 13 of a positive-displacement pump is arranged within the drill rod assembly. Rotor 14 is supported by operating rods 15 whose assembly runs up to the surface, and in particular outside circulating head 11 so that its end 16 is accessible to handling means and rotating means 17.

An instrumentation device 18 is preferably arranged as close as possible to the bit; it allows to measure and to transmit bottomhole parameters, notably the pressures inside and outside the string.

Figure 2:
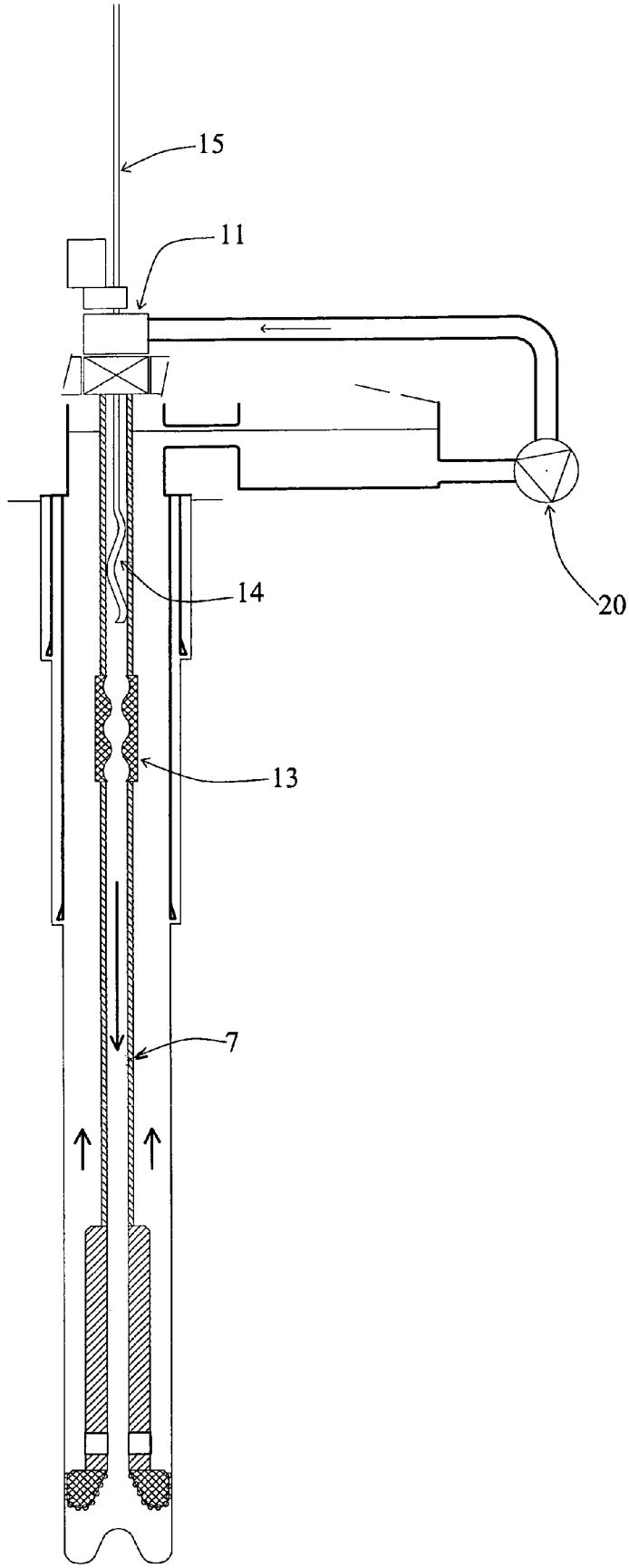
FIG. 2 diagrammatically shows a stage wherein the invention is used.

FIG. 2 shows the drilling rig wherein direct circulation is carried out, i.e. forced circulation by injection of the drilling fluid by surface pumps 20 in the inner space of string 7, by means of circulating head 11. Rotor 14 is therefore removed from stator 13 so as to leave the inner channel free for direct circulation as shown by the arrows. By means of a winch, not shown here, operating rods 15 are pulled by a sufficient length to allow the rotor to be removed from the stator.

METHOD OF OPERATION

In the case of reverse-circulation drilling, the clean drilling fluid flows down through the annulus, circulates around the bit and flows back up through the inside of the rods. To provide positive circulation, the positive-displacement pump (of Moineau type) is positioned at about −400 m, thus allowing to generate a pressure gain and a forced circulation for discharging the laden mud, this circulation facilitating cleaning and cooling of bit 5.

The shape and the structure of the drill bit are suited to distribute the circulation at the working face so as to provide sufficient cleaning and cooling.

This system allows to control the level of the fluid discharged into the annulus, which determines the bottomhole pressure. This adjustable value allows to drill with a controlled bottomhole pressure: over-balanced, at balance or under-balanced, according to the conventional denominations.

According to a preferred variant, the pump is a high-capacity (1500 1/min) Moineau type pump (PCP), with a low pressure gain, between 30 and 50 bars, considering its position in the well.

The pump can be a mono-lobe or a multi-lobe pump (preferably mono-lobe).

The space required by the diameter of the rotor has to be such that it fits in the inside diameter of the rods.

The rotor must rotate left and be driven by rods having left-hand threads so as to prevent them from coming undone during right-hand rotation of the drill string.

Rotation of the drill string being a right-hand rotation, the relative rotation of the rotor (left) in relation to the pipe string (right) decreases the rotating speed applied at the surface to the operating rods.

The diameter of the body of the pump stator can reach the outside diameter of the tool joints (for example: 6¾ tool joint (171.45 mm) for 5" rods (127 mm)).

A rotor positioning device (not shown in the figures) is arranged above the pump stator to prevent passage through the stator, so as to facilitate adjustment of the rotor position in relation to the stator.

Rotary drilling with a table or with an electric or hydraulic driving head requires drive adjustment of the operating rods driving the rotor into rotation.

A mud return is required through the rod by a rotating seal with a seal in rotation on operating rods 15.

MWD (measurement while drilling) type instrumentations 18 measure, among other things, the pressure inside the string and the pressure in the annulus. Thus, the annulus pressure allows to control the height of the fluid column in the annulus, and the internal pressure allows to detect internal pressure anomalies, for example due to inflows in the well: gas or liquid hydrocarbon.

As the hole deepens, the position of the stator becomes increasingly far from the surface. In order to recover an optimum position, a second stator positioned higher than the first one can be screwed onto the drill string when operating the rods. The rotor is lowered, installed and activated by a set of operating rods of suitable length. Of course, in case of round trip, the first stator can return to the optimum position without requiring a second one.

ADVANTAGES OF THE INVENTION

Possibility, according to the drilling stages, of selecting the mud circulation mode: direct or reverse, over-balanced or under-balanced, Bottomhole pressure control by continuous annulus filling height adjustment, and possibility of very fast pressure regime change without changing the mud density, only by adjusting the annulus level, Good drill bit cleaning, circulation through suction at the bit, no cuttings redrilling, Mud:

the viscosity can be reduced since the return velocity in the rods is higher, the mud density is more or less independent of the density required for bottomhole pressure control, faster return of the cuttings, less mixed, less damaged. The information is more direct and faster for the monitoring geologist, No surface HP mud pump, reserved for well control only, or conventional direct-circulation drilling stages, Greatly reduced pumping pressure, hence energy and equipment saving, no wear of the rods subjected to high pressures, no mud damage due to pumping, Possibility of passing through the positive-displacement pump once the rotor is back at the surface to allow servicing with tools in the rods (sticking, measurement), Controlled discharge management since the laden fluid is confined in the rods. It can be readily transferred to a separator, Possible ROP increase, Reduced formation damage and therefore production increase through more suitable drilling.

The present invention can be advantageously used in the following cases:

Drilling depleted zones that require a low bottomhole pressure so as not to damage the reservoir, Under-balanced drilling, Deep to very deep drilling.

The invention claimed is:

1. A reverse-circulation drilling system comprising:

a drill bit, a drill string comprising drill rods, means for bringing said drill bit into rotation by means of said rods, and a positive-displacement pump comprising a stator and a rotor, said stator being fixed to said drill rods, and said rotor being assembled to operating rods having a portion arranged within the drill rods and an upper portion extending out of the drill rods at an upper end.

2. A system as claimed in claim 1, wherein said rotor is driven into rotation in relation to said stator by at least one of the following actions: rotation of the drill rods, rotation of the operating rods connected to the rotor.

3. A system as claimed in claim 1, wherein the rotor of the pump is removed from the stator by dismounting the operating rods.

4. A reverse-circulation drilling method comprising:

rotating a drill bit by means of a drill string comprising drill rods, circulating a drilling fluid in the borehole, and drawing drilling fluid coming from the well bottom with a pump through an inner space of the drill rods and discharging said fluid to the surface through the inner space of the drill rods, so as to provide a reverse circulation, the pump comprising a stator screwed between the drill rods and a rotor assembled to operating rods arranged within the drill rods, said stator being driven into rotation with the drill rods.

5. A method as claimed in claim 4, further comprising driving the rotor into rotation by the operating rods.

6. A method as claimed in claim 4, further comprising controlling a fluid level in the well by a flow rate of said pump and a well filling rate.

7. A method as claimed in claim 4, further comprising removing the rotor by dismounting the operating rods so as to leave the inner space of the drill string free.

8. A method as claimed in claim 7, further comprising carrying out direct circulation by injecting the drilling fluid by means of surface pumps through the inner space of the drill string.

9. A method as claimed in claim 4, wherein the circulating of the drilling fluid in the borehole comprises circulating the drilling fluid from a surface tank down the borehole outside of the drill rods.

* * * * *